United States Patent [19]

Fayer et al.

[11] 4,244,513

[45] Jan. 13, 1981

[54] CENTRIFUGE UNIT

[75] Inventors: Ervin Fayer, Hollywood; Steven H. Setzer, Miramar; Donald A. Gillette, Hollywood, all of Fla.

[73] Assignee: Coulter Corporation, Hialeah, Fla.

[21] Appl. No.: 942,627

[22] Filed: Sep. 15, 1978

[51] Int. Cl.[3] ..... B04B 9/10; B04B 13/00; B04B 15/08; B04B 15/06

[52] U.S. Cl. ..... 233/23 R; 233/1 D; 233/1 A; 318/301

[58] Field of Search ..... 233/23 R, 24, 1 R, 1 D, 233/13, 26, 27, 1 A; 318/301; 366/601, 16, 17, 18, 19, 20, 21, 150

[56] References Cited

U.S. PATENT DOCUMENTS

| | | | |
|---|---|---|---|
| 2,003,621 | 6/1935 | Anderson | 233/1 D |
| 2,173,580 | 9/1939 | Fawcett | 233/1 D |
| 2,656,508 | 10/1953 | Coulter . | |
| 3,633,041 | 1/1972 | Koskela . | |
| 3,676,723 | 7/1972 | Drucker . | |
| 3,750,941 | 8/1973 | Drucker . | |
| 3,774,376 | 11/1973 | Endo | 233/13 |
| 4,014,611 | 3/1977 | Simpson . | |
| 4,076,220 | 2/1978 | Osawa | 366/601 |

OTHER PUBLICATIONS

Article Entitled "Electrophoresis-Experiment MA-014" by Hannig, Schoen, Apollo-Soyuz Test Project Summary Science Report #20:335-352.

"An Improved Horizontal Slab Gel Electrophoresis Apparatus For DNA Separation" by Kaplan, Russo, Wilcox; Analbiochem 78:235-243, 1977.

"Electroanalytical Chemistry" by J. J. Lingane, 2nd ed., New York, Interscience Pub. 1958, pp. 243, 364 and 478.

*Primary Examiner*—Robert W. Jenkins

*Attorney, Agent, or Firm*—William A. Newton; Gerald R. Hibnick

[57] ABSTRACT

Disclosed is an improved centrifuge apparatus for separating substances of varying density and a method of controlling the speed of a rotor of the centrifuge apparatus. A vent-view port is mounted for in-out adjustment within an access aperture formed in a lid of the centrifuge apparatus so as to provide for selective opening of vent holes formed in the vent-view port. In addition to venting, the vent-view port has a sensor mount with a transparent window for receiving a tachometer probe for rotor speed monitoring. Additionally, a desired centrifugal force and a desired accumulative centrifugal force can be entered by a human operator. A control unit adjusts the rotor speed and operational cycle time to meet the inputted desired force values while displaying the actual accumulative centrifugal force at the end of the operation cycle.

24 Claims, 6 Drawing Figures

CENTRIFUGE UNIT

FIELD OF THE INVENTION

The present invention relates to centrifuge units used for a wide variety of purposes in which it is desired to separate various constituents of a sample by centrifugal forces.

BACKGROUND OF THE INVENTION

Many types of centrifuge units in the prior art are designed for separating substances of varying density by centrifugal force. These centrifuges, for the most part, comprise an outer housing with an inner rotating rotor which is spun by a motor driven spindle. Carriers containing the samples are located on the circumference of the rotor. The centrifuge units are generally provided with a latchable lid that remains latched during an operation cycle of the unit in which the substances are separated and until the rotor stops rotating.

The prior art centrifuge units and the procedures used in washing contaminants from such units are generally deficient in the manner in which biological hazardous substances are handled. More specifically, it has long been known that in handling blood containing hepatitis that some safety precautions are needed. Such precautions in the past have involved the use of masks, gowns, and gloves by human operators to prevent physical exposure to such biological hazardous substances. No successful schemes have been provided by the prior art to completely remove the operator from close proximity with these contaminants. More specifically, with the prior art units the operator is normally placed in relatively close contact with contaminants during the washing, flushing and draining of the unit. The cleaning and sterilizing procedures for the prior art units invariably involve the operator opening the lid of the unit and subsequently scrubbing the interior of the unit and/or sterilizing the same with a sterilizing agent. Even with the use of protective coverings, the operator assumes definite risk during the cleaning process. These risks and others like them have led the government and the industry to be increasingly concerned with biological hazard containment and have recently been responsible for the introduction of new regulations and guidelines. Generally, the prior art centrifuges do not possess sufficient biological containment features to meet these new regulations and guidelines. Such deficiencies in biological hazard containment will be discussed hereinafter.

Generally, the prior art centrifuge units may be divided into sealed refrigerated units and non-refrigerated units. Some of the non-refrigerated units have at least one aperture formed in the lid which allows for the suction of air into the unit. This negative pressure is produced by the spinning rotor and is used to produce an air flow to cool the motor portion of the system. Also, the aperture defines an open system which allows the system to be drained at the end of a run. With the prior art refrigerated units, there are generally no apertures formed in the lids in that a closed system having a cooled, controlled environment must be maintained. Consequently, the refrigerated units of the prior art define an atmospherically closed system in which no outside ambient air is introduced during the operation cycle of the unit. On the other hand, the non-refrigerated units of the prior art normally define an atmospherically open system in which a continuous flow of ambient air is maintained into the unit during the operation cycle of the unit.

Normally, cleaning and/or sterilizing procedures for refrigerated and non-refrigerated units of the prior art include opening the lid and introducing water and/or a cleaning agent or sterilizing agent into the interior. After manually scrubbing the unit to clean the same, the remaining cleaning liquid collects in a guard bowl positioned under the rotor. This liquid can be removed by flushing the same through a gravity drain formed in the guard bowl. In some prior units, an additional step is introduced into the cleaning process after manual cleaning, such step including operating the rotor so as to stir the cleaning liquid in the guard bowl while draining such liquid. In the prior art refrigerated units, the flushing through a drain normally requires that the lid be kept open. In summary, the prior art cleaning and/or sterilizing procedures call for the opening of the lid for the introduction of the cleaning liquid and/or sterilizing agent and for manual cleaning, thereby exposing the operator in some cases to biological hazards.

Another inherent problem in the prior art centrifuge units is that the non-refrigerated units may release contaminants through the previously described aperture in the lid after the unit has shut off. More specifically, while operating, the inflowing ambient air into the unit caused by the negative pressure therein prevents contaminants from escaping. However, upon intentionally or unintentionally stopping the unit, negative pressure ceases and contaminants may escape.

Federal government regulations require some form of calibration, which is not interior of the units, be used for providing a dynamic indication of actual rotor speed (RPM). Hence, speed measuring devices must be independent of the centrifuge unit, or to put it another way, not built into the unit.

The centrifuge units of the prior art normally have as input data the following: (1) speed in rotations per minute (RPM) and (2) time for the operation cycle. The following mathematical relationship is well known in the art:

$RCF = 1.119\ (10^{-5})\ R(N)^2$, where

RCF = Relative centrifugal force in kilograms,

N = RPM, and

R = Sample tip radius in centimeters.

The relative centrifugal force (RCF), if excessive, can impair proper sample separation and can cause damage to the sample, sample carrier rotor to spindle. Sample tip radius (R) can vary substantially depending upon the rotor and carrier being used. Hence RCF better correlates than RPM as a measurement for avoiding the above described undersirable effects. As a result, the diagnostic companies have initiated the practice of specifying maximum tolerances on tubes and samples in terms of RCF. Moreover, centrifuge procedures are beginning to refer to an applied constant RCF level as one of the parameters rather than, or at least in addition to RPM. An operator of a state of the art centrifuge unit must use the above equation or a chart to come up with the RCF in determining a proper RPM input. Since this necessary step frequently is not understood or simply ignored, machine and sample damage and improper sample separation are common.

It is scientifically known that, in addition to RCF, accumulative RCF (G-time) correlates closely to degree and quality of separation of a specimen. Referring to FIG. 5 of the drawings, a typical graph of RCF (G's) versus time is shown for an illustrative centrifuge unit.

The area of the graph represents accumulative RCF. As already explained, the standard machine inputs for prior art units is time (T) for the operation cycle and a constant RPM. Through the previously stated equation, the constant RPM for a given sample tip radius can be used to calculate a constant RCF. The constant RCF is illustrated by the horizontal portion of the graph of FIG. 5 between $t_A$ and $t_B$. In practice, the time T input will correspond to $T=t_B$ in FIG. 5. After $T=t_B$, it is normal to allow the centrifuge rotor to coast to a stop or, alternatively, apply a braking action to expedite stoppage of the rotor. The inputted values of time T and constant RPM are based on diagnostic procedures which presuppose that the accumulative RCF will be equal to the heretofore mentioned constant $RCF \times t_B$. However, due to the acceleration ramp (before $t_A$) and deceleration ramp (after $t_B$) of the graph of FIG. 5, the area of the graph (actual accumulative RCF) rarely is equal to the prescribed (constant $RCF \times t_B$) upon which the input values are based. Therefore, even though the centrifuge unit can be operating at a proper level of RCF, the total accumulative RCF may deviate sufficiently from the desired value so as to give poor separation results.

It is of further interest to note that it is a common practice in the art to vary the length of time for deceleration of the rotor by applying a braking force instead of just allowing the unit to coast to a stop. Any estimate of the accumulative RCF must take this into account.

In summary, a given quantity of accumulative RCF at a known, controlled RCF is more effective in separating a sample than the same accumulative RCF at an arbitrary unknown RCF. The total accumulative RCF relates to the effectiveness of separating a sample. Consequently, a proper level of RCF and a proper amount of accumulative RCF must be applied to a sample in order to achieve a desired separation.

SUMMARY OF THE INVENTION

The present invention is directed toward an improved centrifuge apparatus having a vent-view port for venting the apparatus and for monitoring rotor speed with an external tachometer. Furthermore, the present invention is directed toward an apparatus and method for selecting a proper rotor speed to accurately separate substances of varying density, without damage to the sample or equipment.

The vent-view port is mounted in an access aperture formed in a housing lid of the centrifuge apparatus and is capable of in-out adjustment relative to the housing lid, so as to provide for selective opening of vent holes formed in the vent-view port. The vent-view port further includes a sensor mount for a probe of the tachometer, such sensor mount having a transparent window for monitoring rotor speed.

During an operation cycle of a closed system embodiment of the apparatus, the vent-view port is adjusted in an inward direction, resulting in closing off the vent holes and forming a sealing engagement with the housing lid, while allowing for the mounting of the sensor probe to monitor speed. After the operation cycle, the vent-view port will be raised for introducing through the vent holes a cleaning fluid, such as air, and/or a sterilizing agent. Then the apparatus can be operated to clean itself by spinning the cleaning agent in the guard bowl and flushing it out through a drain. The vent-view port is raised in an upward direction during this cleaning mode to allow for venting and therefore the draining of the cleaning agent.

During the operation cycle of an open system embodiment of the apparatus, the vent-view port is disposed in its raised disposition to allow venting for the purpose of cooling the apparatus. However, after the operation cycle, the vent holes of the unit will be shut to cause contaminants to remain in the apparatus until cleaning or/and sterilizing in the same manner as the closed system embodiment.

In summary, the vent-view port allows for the lid to be closed during the introduction of the cleaning fluid and/or sterilizing agent and while cleaning the unit. Unlike the prior art units, having the closed lid during all stages complies with new governmental regulations which strictly regulate operator's contact with contaminants and in practice requires the lid to be closed. Additionally, the vent-view port complies with governmental requirements of having external monitoring of rotor speed. Also, the vent-view port can maintain a closed system during the operation cycle with only one airtight access opening being formed through the insulation.

A control unit is provided with means for inputting operator entered values of cycle time, RCF and sample tip radius and for determining rotor speed from the imputted values. Since knowledge of centrifugal force is better than RPM for sample separation prevention of sample and apparatus damage, the control unit provides the operator with means of selecting a safe rotor speed, while still achieving the required RCF and cycle time. Moreover, display means are provided for visually displaying computed accumulative RCF value, which correlates closely with the desired degree and quality of separation and thereby assists the operator in obtaining better separation results. Moreover, means are provided for inputting desired accumulative RCF and subsequently adjusting the time of the operation cycle to assure that the actual accumulative RCF matches the desired inputted value.

BRIEF DESCRIPTION OF THE DRAWINGS

Further objects and advantages of the present invention will become apparent as the following description proceeds, taken in conjunction with the accompanying drawings in which.

DETAILED DESCRIPTION OF THE PREFERRED EMBODIMENT

Figure 1:
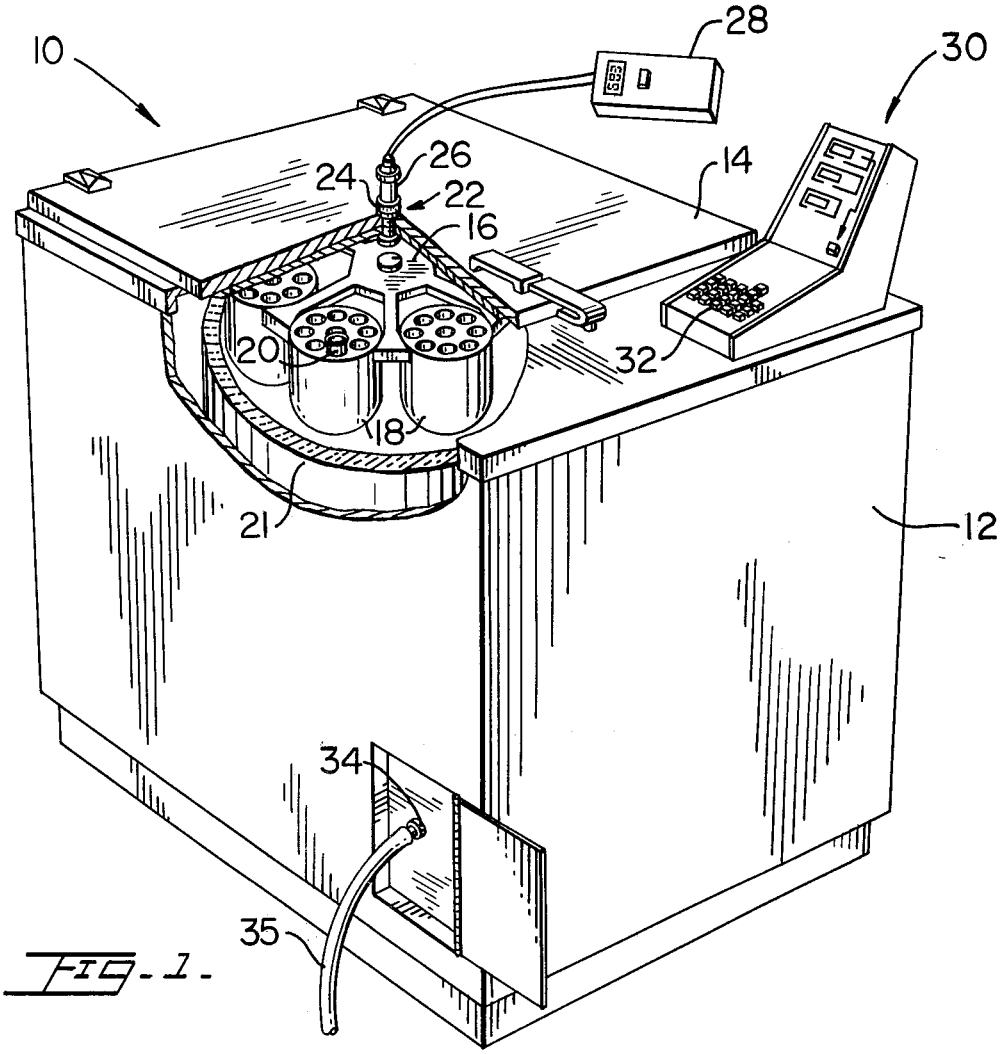
FIG. 1 is a perspective, partially fragmented view of the centrifuge of the present invention.

A centrifuge, generally indicated by numeral 10 in FIG. 1, comprises an outer housing 12 with a latchable lid 14. In FIG. 1, the housing 12 and the lid 14 are partially broken away to show a typical horizontal rotor 16 having symmetrically distributed cups 18 mounted thereon containing a plurality of tubes 20. The rotor 16 is disposed above a guard bowl 21. Generally, any rotor arrangement such as, for example, a fixed angle rotor or a horizontal rotor, may be used with the present invention and all the structures heretofore described are of conventional design. Typical examples of conventional centrifuges are illustrated in U.S. Pat. Nos. 3,633,041, 3,750,941, and 3,676,723.

Referring to FIG. 1, a vent-view port 22 of the present invention is mounted on and passes through lid 14. The vent-view port 22 comprises an enlarged upper end which defines a sensor mount portion 24. This sensor mount portion 24 receives and supports, in a removable manner, a probe 26 of a photoreflective, preferably digital tachometer 28, normally of the hand-held portable type. This tachometer 28 detects and displays the speed of the rotor 16 in a manner to be described hereinafter. A control unit 30 is mounted to the top of the housing 12 and provides a digital keyboard 32 for the entry of various data parameters with verification displayed. In the lower portion of the housing 12 there is disposed a hose fitting 34 to attach a drain hose 35 for flushing the system.

Figure 2:
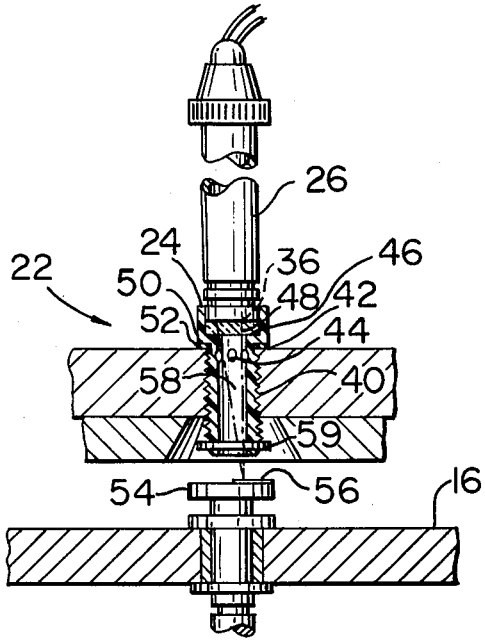
FIG. 2 is a fragmented enlarged plan view of the vent-view port of the present invention.

As depicted in FIG. 2, the vent-view port 22 has a sensor receiving aperture 36 formed in the sensor mount portion 24 and is configured and dimensioned to receive the probe 26. The vent-view port 22 further includes a threaded shank portion 40 integrally connected to the sensor mount portion 24 by a neck portion 42 which has a plurality of vent holes 44, such as six, formed therein. Secured in sealed relationship to an aperture base 46 of the sensor mount portion 24 is a transparent window 48. The three portions 24, 40 and 42 preferably have cylindrical configurations with the sensor mount portion 24 having a larger diameter than the shank and neck portions so as to define a ledge 50. Attached to the ledge 50 is preferably a gasket seal 52 which allows for an airtight seal between the housing 12 and the ledge 50 when the vent-view port 22 is securely screwthreaded into mating threads of the lid 14, as illustrated in FIG. 2. The window 48 provides access to the inner regions of the centrifuge 10 so that a light beam may emanate from the probe 26, be reflected from preferably a flat knob portion 54 of the rotor 16 and then be detected by the probe 26. Preferably, a mark 56 is formed in the knob portion 54 so that as the same rotates, the change in reflection of the light beam received by the probe 26 allows for the determination of RPM in a manner well known to the art. As discussed in the Background section, this exterior monitoring of the tachometer 28 is required by governmental regulation.

The vent-view port 22 may be incorporated into the centrifuge 10 of a closed system type. The closed system centrifuge may, but not necessarily, be a refrigerated system well known to the art in which a cooled, controlled environment is maintained in the interior of the same. When the centrifuge 10 is in its operation cycle, the vent-view port 22 has been seated so that the seal 52 maintains a closed refrigerated system. After the end of the operation cycle, a cleaning fluid and/or a sterilizing agent can be introduced by opening the vent holes 44 and supplying cleaning fluid which can be air, water and/or a sterilizing agent. A supply of the cleaning fluid or sterilizing agent can be introduced by attaching a hose or other input connection (not shown) to the vent-view port 22. The centrifuge 10 then can clean itself by operating the unit, which cleans the guard bowl 21 and flushes the waste through the drain hose 35, which can be coupled to a biohazard containment arrangement, known generally, but not normally utilized with centrifuge units.

As explained in the Background section, venting should be accomplished without opening the lid 14. This is accomplished by rotating the vent-view port 22 upward so that the vent holes 44 formed in the neck portion 42 are above the upper surface of the lid 14. These vent holes 44 lead to an inner channel 58 formed in the vent-view port 22, such channel 58 being terminated by the window 48 at one end and forming an opening into the interior of the centrifuge 10 at the other end. Hence, the threaded shank portion 40 provides for in/out adjustment of the vent-view port 22. A stop mechanism, such as a stop nut 59, can be included to prevent the shank portion 40 from coming completely free from the lid 14.

The vent-view port 22 also can be incorporated into a centrifuge unit which is an open system type. The vent-view port 22 would provide venting for the unit as previously described: however, this would also occur during the operation cycle of the unit, when sample separation is occurring, and not just during the cleaning and sterilizing stages. More specifically, as described in the Background section, such an open system has a continuous flow of ambient air into and out from the system, to cool the motor portion of the system. The inherent problem in the prior art centrifuges is twofold: during operation, aerosols and other substances containing contaminants can be entrained in the out/flowing motor cooling air; and once the negative pressure ceases or substantially lessens, air containing possible contaminants can escape from the air inflow apertures formed in the lid 14. However, with the incorporation of the vent-view port 22, the same can be shut when the negative pressure ceases due to the rotor 16 coming to a stop. The vent-view port 22 can be used for introducing cleaning and/or sterilizing substances and for venting during a cleaning/flushing cycle, in the same manner as was described with the closed system, including facilitating biohazard containment.

A conventional check or flapper valve (not shown) can be incorporated in the vent-view port 22 to prevent the out flow of contaminants through the vent-view port 22, when a sufficient negative pressure ceases to exist within the interior of the centrifuge unit 10. With the centrifuge apparatus of the closed system type and the open system type, such valve can be of use during the cleaning and sterilizing stage. Also, with the open system type, this valve could be of use during the operation cycle. In short, any time the vent holes 44 are open, for proper operation of the unit 10, there should be a negative pressure in the interior relative to the exterior. Should this negative pressure be lost before the vent-view port 22 is manually closed, the valve would automatically close the channel 58, preventing contaminants from escaping.

As explained in the Background section, inserts into the interior of the centrifuge 10 require expensive insulation. By virtue of the unique design of the vent-view port 22, only one insert through the lid 14 is necessary.

Figure 3:
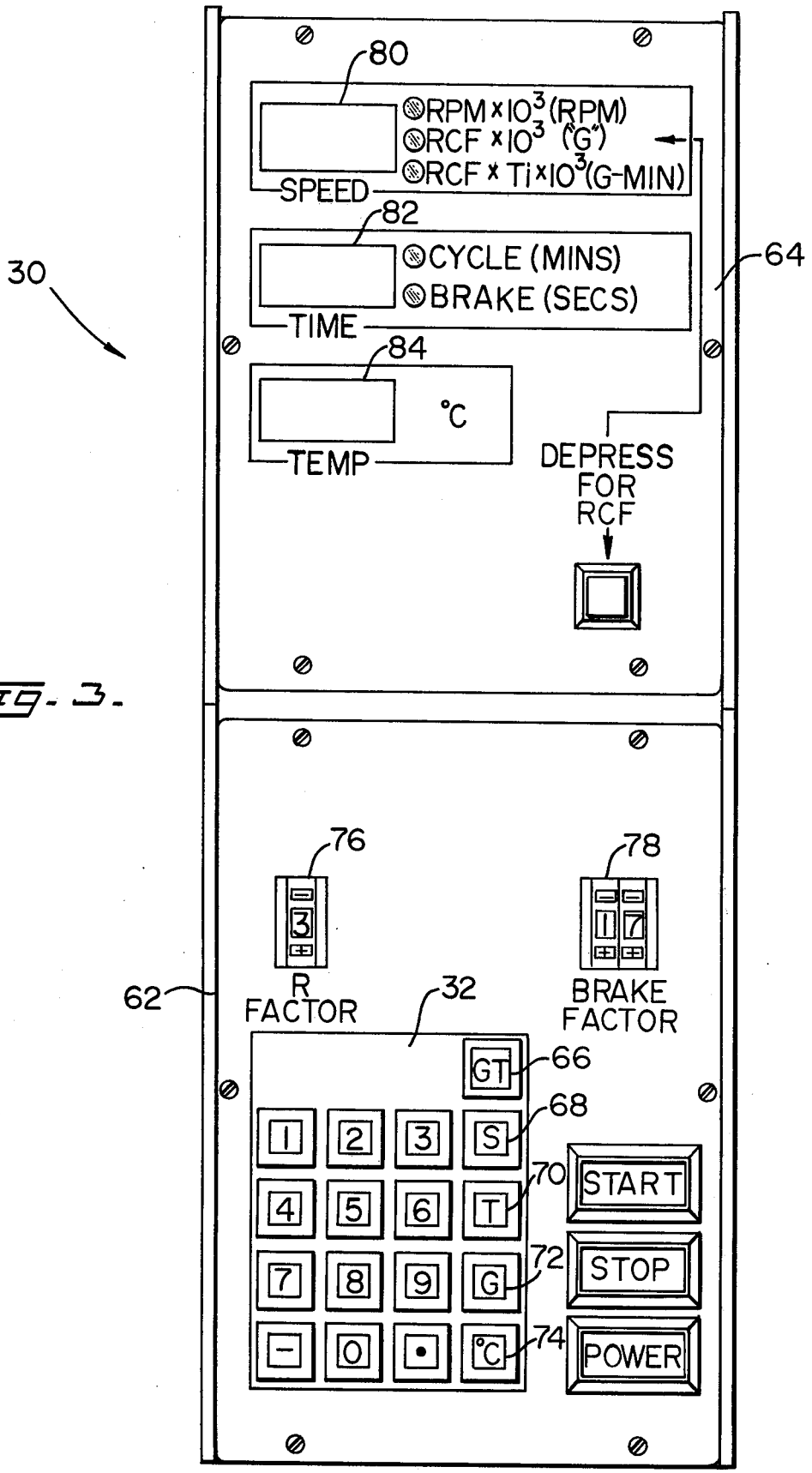
FIG. 3 is a plan view of the control panels of the present invention.

As shown in FIG. 3, the novel control unit 30 is provided with two panels, a data entry panel 62 and a parameter monitor panel 64. Disposed on the data entry panel 62 is the digital keyboard 32 having an accumulative RCF entry key 66, a RPM entry key 68, a time entry key 70, a RCF entry key 72 and a temperature entry key 74. In the first mode of operation, constant RCF and time of the operation cycle are inputted and in an alternative second mode of operation accumulative RCF and constant RCF are inputted. In other words, either time is inputted; or, in its place, accumulative RCF is inputted. The way in which the control unit 30 uses these parameters will be clarified subsequently. A third mode of operation similar to that of the prior art is available to the operator in which RPM and time are inputted. Also, there is a sample tip radius entry dial 76 and a brake factor entry dial 78, such dials normally being tumblewheel switches.

Referring to FIG. 3, the parameter monitor panel 64 has disposed thereon various displays for verification that actual operation parameters coincide with the entered, desired parameters. More specifically, the panel 64 has a speed display panel 80 for showing RPM, RCF and G-TIME, a time display panel 82 for showing the operation cycle time and the time for braking or coasting to a stop, and a display panel 84 for showing the temperature.

Figure 4:
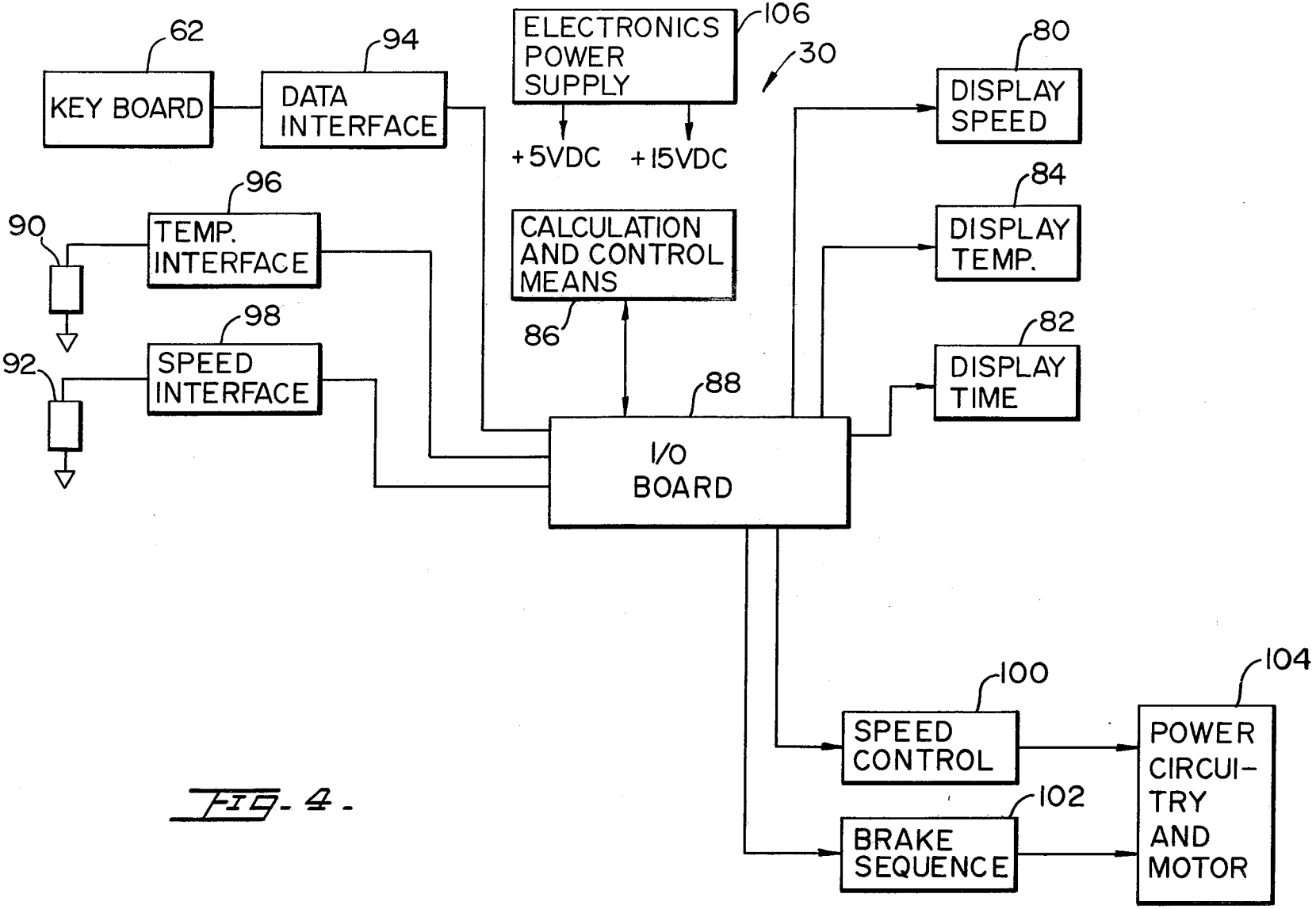
FIG. 4 is a block diagram of the input, control and output circuitry of the present invention.

Referring to FIG. 4, there is illustrated a generalized block diagram of the control unit 30. The heart of the control unit 30 is the calculation and control means 86. In the preferred embodiment, the calculation and control means 86 comprises a preprogrammed microprocessor of a type commonly available in the marketplace. The specific structure and functions of the microprocessor circuitry are not presented here in that they are of conventional design. As with all microprocessors, the microprocessor is a digital computer which has as a primary job the processing of data and the control of external equipment. However, it should be appreciated that the processing of data and the automatic control of equipment could be performed by hardware circuitry. Therefore, any hardware circuitry performing these functions in the same or equivalent manner is considered equivalent for the purposes of this invention.

The actual data processing that occurs in the control and calculation means 86 will be explained subsequently in the discussion of FIGS. 5 and 6. In reference to FIG. 4, it should be appreciated that the control and calculation means 86 performs the normal central processor functions of internal memory, arithmetic and logic calculations, and equipment control. Inputs to an input-output circuit board 88 are provided from the data entry panel 62, from a temperature transducer 90 and from a speed transducer 92. In that the preferred embodiment has a calculation and control means 86 which comprises a microprocessor, a data interface 94, a temperature interface 96, and a speed interface 98 are interposed between the previously described signal sources and the input-output circuit board 88, so as to provide digital data. The input-output circuit board 88 contains a number of conventional latches, decoders and other commonly found elements to effect and direct the flow of information between the calculation and control means 86 and the external circuitry, such as the previously described signal sources and the digital displays 80, 82, and 84. Consequently, from the interface boards 94, 96, and 98, the input-output circuit board 88 receives temperature and speed signals and digital data from the data entry panel 62. Such information is provided to the calculation and control means 86, which in turn returns certain control signals and calculated data back to the input-output circuit board 88. The input-output circuit board then displays certain calculated parameters and directs other control signals to a speed control means 100 and a brake sequence means 102. Preferably, the speed control means 100 could comprise a well known SCR bridge arrangement for varying the speed of the motor of the power circuitry, generally indicated by the numeral 104. The power circuitry 104 comprises the normal conventional arrangements of a motor, compressor, transformers, and other necessary elements that are well known to one skilled in the art. Power to the control and display circuitry is from a power supply means 106. The specific construction of all of the previously described elements illustrated in FIG. 4 can be of conventional design and are identified here for the purpose of providing a background for the areas of novelty. More specifically, the novelty associated with the control unit 30 will be described in the discussion of FIGS. 5 and 6.

Figure 5:
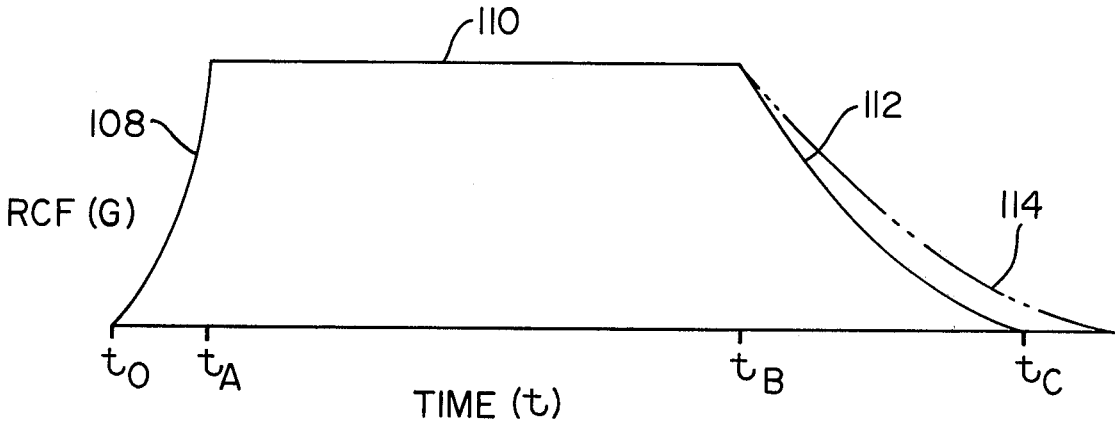
FIG. 5 shows a graphic representation of the RCF as a function of time.

FIG. 5 is a graphical representation of the RCF as a function of time. More specifically, this graphical representation is typical of the profile of RCF found in almost any conventional centrifuge. Noramlly, there is an acceleration ramp 108, a constant RCF portion 110 of the graph, and a deceleration ramp 112. The acceleration ramp 108 extends from time $t_O$ to time $t_A$ and represents the period during which the rotor 16 is accelerating. This period usually lasts from one-half to three minutes. The portion of the graph extending from time $t_A$ to time $t_B$ illustrates the period in which the rotor generates a relatively constant RCF during a constant rotor speed portion of the operation cycle. The portion of the graph from $t_B$ to $t_C$ represents the deceleration ramp in which the rotor is either coasting to a stop or has a braking action applied to it so as to expedite its stopping. The deceleration ramp 112 is illustrative of a ramp having some braking action applied to it; whereas the deceleration ramp 114 is illustrative of a rotor which coasts to a stop. The ramps can be normally approximated by exponential curves in that the RPM values during these periods are substantially linear. As discussed in detail in the Background section, the diagnostic procedures provided to the operator consist of a desired constant RPM, which correlates with a constant RCF, and a time during which this constant RCF should be maintained. This provides an accumulative RCF value that will create the desired separation of the samples. However, when the operator inputs these two variables into the prior art centrifuges, the time value will correspond to $t_B$. In the graph illustrated in FIG. 5, the operator would be receiving more accumulative RCF than the diagnostic procedures specified. As is apparent from FIG. 5, the error is introduced by the area under the deceleration ramp 112 being greater than the area under the acceleration ramp 108. Hence, as explained in the Background section, the operator needs the ability to know the actual accumulative RCF at the end of an operation cycle and optionally, the operator should have the ability to specify a given RCF and/or a given accumulative RCF as an input.

Figure 6:
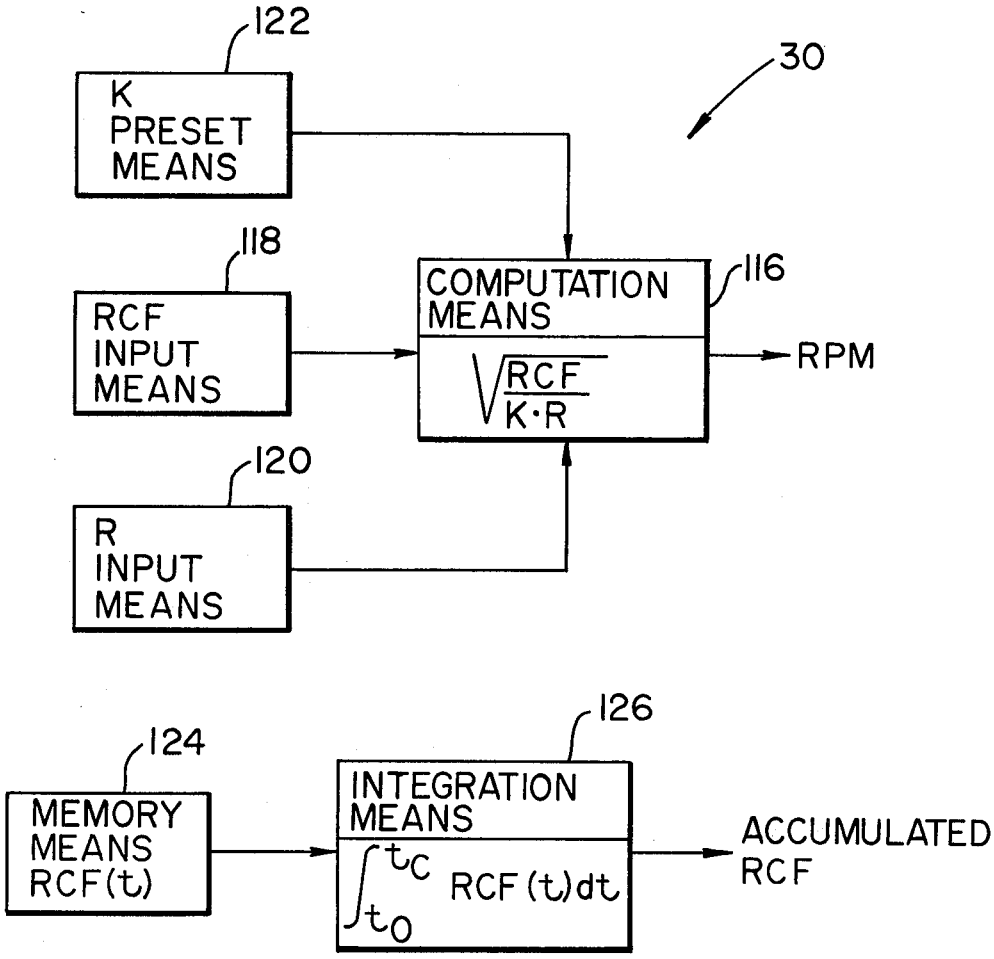
FIG. 6 shows a detailed block diagram of the logic unit.

Referring to FIG. 6, the first area of novelty of the control unit 30 is the ability of the operator to enter a selected constant RCF for constant speed operation instead of a RPM value commonly entered in the prior art centrifuges. However, to operate the motor of the centrifuge 10, a RPM value must be computed. Consequently, the calculation and control means 86 provides RPM computation means 116 for calculating motor speed (RPM) by using the previously described RCF equation. More specifically, the keyboard 32 and associated circuitry shown in FIG. 4 provide force input means 118 for inputting a preselected RCF value into the calculation and control means 86. Sample tip radius entry dial 76 and associated circuitry shown in FIG. 4 provide radius input means 120 for inputting a preselected rotor diameter (R) into the calculation and control means 86. A constant K is preset in the calculation and control means 86 by constant preset means 122. In the preferred embodiment, a software calculation of RPM is performed using the inputted values of RCF and R and then solving the following RCF equation for RPM:

$RCF = 1.119\ (10^{-5})\ R(N)^2$, where

RCF = Relative centrifugal force in kilograms,

N = RPM, and

R = Sample tip radius in centimeters.

As shown in FIG. 6, a second additional area of novelty resides in providing the operator with a readout of the actual accumulative RCF (G-Time) for an operation cycle. This readout is available for any of the three modes of operation previously described. Basically, this is accomplished by finding the area under the graph shown in FIG. 5. More specifically, memory means 124 stores RCF as a function of time. Next, the control and calculation means 86 provides integration means 126 for integrating the graph of FIG. 5 as follows:

$$\text{accumulative } RCF = \int_{t_0}^{t_C} RCF(t)\, dt.$$

Furthermore, nonlinear representations of the RCF(t) function can be incorporated into the control and calculation means 86.

A third area of novelty of the control unit 30 resides in the second operating mode of the control unit 30. As previously mentioned and depicted in FIG. 3, the operator has the option of inputting time through the time entry key 70 or alternatively entering accumulative RCF through the accumulative RCF entry key 66. If the latter option is chosen, the keyboard 32 and its associated circuitry shown in FIG. 4 provide means for inputting the accumulative RCF value into the calculation and control means 86. In addition, the means 86 receives the brake factor from the data entry panel 62 and its associated circuitry. The calculation and control means 86 in this mode preferably performs the following steps and computations:

1. As the operation cycle proceeds through the acceleration ramp 108 the actual area under the acceleration ramp 108 is calculated by integration and stored in memory.

2. The means 86 forecasts with a high degree of accuracy the area under the deceleration ramp 112 by taking into account such factors as the constant RCF, an estimated load and the braking factor and then projecting the deceleration ramp 112.

3. The means 86 then sums the actual integrated area under the acceleration ramp 108 and the forecasted integrated area under the deceleration ramp 112, and subtracts this total from the inputted desired total accumulative RCF.

4. The remaining accumulative RCF value, after the above subtraction step, is divided by the inputted desired RCF to compute a delta difference ($t_B - t_A$). Since $t_A$ is known, this delta difference may be used to calculate $t_B$ in that $t_A + (t_B - t_A) = t_B$ ($t_B$ being the time at which constant speed is terminated as shown in FIG. 5).

5. The calculation and control means 86 then provides a control signal to have the rotor 16 enter its coast or braking mode upon reaching the computed time $t_B$. In addition, the operator may optionally enter individual weighting factors (less than 1.0) to be multiplied with the actual acceleration ramp area and/or the forecasted deceleration ramp area to more accurately reflect the contribution of these areas to the separation of the sample. Furthermore, the means 86 continues to calculate the actual as opposed to forecasted accumulation RCF, which will allow the operator to see just how accurate the forecasted value was.

Although particular embodiments of the invention have been shown and described herein, there is no intention to thereby limit the invention to the details of such embodiments. On the contrary, the intention is to cover all modifications, alternatives, embodiments, usages and equivalents of the subject invention as fall within the spirit and scope of the invention, specification and the appended claims.

What is claimed is:

1. A vent-view port used in combination with a centrifuge apparatus for separating substances of varying density, said centrifuge apparatus having a housing and a rotor disposed within the housing; the combination comprising:

the housing defining an access aperture formed therethrough;

said vent-view port being mounted for relative movement in said access aperture and including vent means for providing venting of the apparatus and for input of contaminant eliminating fluids;

said vent-view port including means for effecting relative movement of said vent-view port within said access aperture for selectively opening and closing said vent means.

2. In the vent-view port of claim 1, said vent-view port including a transparent window whereby rotor speed monitoring may be accomplished through said transparent window, when said vent means is closed as well as open.

3. In the vent-view port of claim 2, said vent-view port including a sensor mount portion;

said sensor mount portion including a sensor-receiving aperture dimensioned and configured to receive a probe of an optical tachometer, and said transparent window being secured at the base of said sensor-receiving aperture of said sensor mount portion in sealed relationship to said sensor mount portion.

4. In the vent-view port of claim 2, said vent-view having a longitudinal axis and a channel disposed along said longitudinal axis, said channel terminating at one end with said transparent window and opening into the interior of the housing at the other end; and said vent means opening into said channel.

5. In the vent-view port of claim 2, a mark formed on the rotor and radially disposed relative to its center of rotation, whereby changes in light reflection can be transmitted through said window for rotor speed monitoring.

6. In the vent-view port of claim 2, the housing of the centrifuge apparatus including a lid for access into the interior of the housing, and said access aperture being formed in said lid.

7. In the vent-view port of claim 6, said vent-view port having a longitudinal axis disposed in substantially parallel relationship to the axis of rotation of the rotor.

8. In the vent-view port of claim 1, said vent-view port including a probe-receiving sensor mount portion exteriorly positioned relative to the housing.

9. In the vent-view port of claim 8, said vent-view port further including a neck portion integrally attached to said sensor mount portion, and being in fluid conducting communication with the interior of the housing.

10. In the vent-view port of claim 9, said vent-view port further including a shank portion dependin from said neck portion, and positioned within said access aperture to enable relative axial motion therewith.

11. In the vent-view port of claim 10, said shank portion having screwthreads formed thereon for mating relationship with screwthreads formed in said access aperture, whereby rotation of said vent-view port provides the relative motion as an in-out adjustment.

12. A control unit for separating biological substances used in combination with a centrifuge apparatus which includes a motor for rotatably driving a rotor, said control unit comprising:

force input means for providing operator entry of input data representing a desired level of centrifugal force, computation means for calculating motor rotational speed using said input data representing a desired level of centrifugal force, memory means for recording and recalling actual centrifugal force as a function of time, integration means for integrating said actual centrifugal force over a predetermined time interval of the operational cycle of the centrifuge unit so as to compute an accumulative centrifugal force quantity, and display means for visually displaying the computed accumulative centrifugal force quantity.

13. In the control unit of claim 12, radius input means for providing operator entry of input data representing a sample tip radius value, so as to make said sample tip radius value accessible to said computation means, constant preset means for presetting a constant, so as to make said constant accessible to said computation means.

14. In the control unit of claim 12, forecasting means for projecting expected accumulative centrifugal force quantity, input means for providing operator entry of input data representing desired accumulative centrifugal force for the operation cycle of the centrifuge apparatus, and calculation means for calculating a constant speed running time for the centrifuge apparatus that makes said forecasted accumulative centrifugal force quantity equal to said desired accumulative centrifugal force.

15. In the control unit of claim 14, means for weighting the contribution to said computed and forecasted accumulative centrifugal force quantities of the centrifugal force during acceleration and deceleration of the rotor.

16. A method of controlling speed of a motor-driven rotor of a centrifuge unit by utilizing calculation and control means, said method comprising the steps of:

inputting by operator entry into the calculation and control means input data representing a desired level of centrifugal force for constant speed operation, inputting into the calculation and control means input data representing a sample tip radius dimension, determining with the calculation and control means, from the input data, a rotational speed for the rotor, and setting, by use of the calculation and control means, the speed of the rotor to the determined rotational rotor speed, recording the actual centrifugal force during an operation cycle of the centrifuge unit, integrating the recorded actual centrifugal force over an interval of time substantially equal to that of the operation cycle, so as to compute an accumulative centrifugal force quantity, said recording and integrating utilizing the calculation and control means, and visually displaying the computed accumulative centrifugal force quantity.

17. In the method of claim 16, and utilizing the calculation and control means, the steps of:

inputting by operator entry input data representing a desired accumulative centrifugal force for an operation cycle of the centrifuge unit, forecasting the expected accumulative centrifugal force quantity, determining the time for the operation cycle to be such that the forecasted accumulative centrifugal force quantity substantially equals the inputted desired accumulative centrifugal force, and setting the time of the operation cycle to that of the computed time.

18. In combination with a centrifuge apparatus, of the type wherein a housing encloses a motor-driven rotor, for separating biological hazardous substances of varying density, the improvement comprising:

access means for venting the interior of the housing, said access means being capable of an open state when venting is desired and a closed state when venting is not desired, said access means being in its open state for venting when said centrifuge apparatus is being operated to clean itself, whereby the housing can be vented with said access means in said open state when a sufficient negative pressure exists inside the housing to prevent biological contaminants from escaping.

19. In the combination of claim 18, said access means providing means for introducing contaminant-eliminating fluids into the interior of the housing.

20. In the combination of claim 19, said access means being in its open state when contaminant-eliminating fluids are introduced therethrough.

21. In the combination of claim 18, valve means for automatically providing said closed state when a difference in internal and external pressures of said housing decreases to a predetermined level, whereby said access means automatically assumes its closed state so as to prevent contaminants from escaping through same.

22. In the combination of claim 18, said centrifuge apparatus comprising a closed system centrifuge, and said access means being in its closed state during separation of substances, whereby the environment within said housing is controlled.

23. In the combination of claim 18, said centrifuge apparatus comprising an open system centrifuge, and said access means being in its open state during the separation of substances.

24. In combination with a centrifuge apparatus, of the type wherein a housing encloses a motor-driven rotor, for separating substances of varying density, the improvement comprising:

access means for venting the interior of the housing, said access means being capable of an open state when venting is desired and a closed state when venting is not desired, whereby the housing can be vented with said access means in said open state when a sufficient negative pressure exists inside the housing to prevent biological contaminants from escaping, valve means for automatically providing said closed state when a difference in internal and external pressures of said housing decreases to a predetermined level, whereby said access means automatically assumes its closed state so as to prevent contaminants from escaping through same.

* * * * *